US006073789A

United States Patent [19]

Lundblade

[11] Patent Number: 6,073,789

[45] Date of Patent: Jun. 13, 2000

[54] PORTABLE THERMAL CONTAINER WITH REVERSIBLE DOOR

[75] Inventor: Gene D. Lundblade, Wichita, Kans.

[73] Assignee: The Coleman Company, Inc., Wichita, Kans.

[21] Appl. No.: 08/851,414

[22] Filed: May 5, 1997

[51] Int. Cl.[7] ..... B65D 25/04

[52] U.S. Cl. ..... 220/4.22; 220/4.23; 220/826; 220/840

[58] Field of Search ..... 220/338, 334, 220/335, 337, 4.22, 4.23, 826, 840, 836

[56] References Cited

U.S. PATENT DOCUMENTS

| | | | |
|---|---|---|---|
| 3,072,280 | 1/1963 | Spadaro | 220/4.22 |
| 3,399,938 | 9/1968 | Wallace . | |
| 3,612,355 | 10/1971 | Schurman | 220/338 |
| 3,971,231 | 7/1976 | Derry . | |
| 3,979,007 | 9/1976 | Thornbloom, Jr. | 220/756 |
| 4,220,253 | 9/1980 | Thomas et al. | 220/338 |
| 4,726,193 | 2/1988 | Burke . | |
| 5,065,887 | 11/1991 | Schuh et al. | 220/338 |
| 5,119,966 | 6/1992 | McKim et al. | 220/340 |
| 5,319,937 | 6/1994 | Fritsch . | |
| 5,366,106 | 11/1994 | Kahl | 220/338 |

*Primary Examiner*—Joseph M. Moy
*Attorney, Agent, or Firm*—Kramer Levin Naftalis & Frankel LLP

[57] ABSTRACT

A portable thermal container such as a thermoelectric cooler is provided with a reversible door. The housing includes first and second pairs of opposed walls which form a generally rectangular opening. Each of the walls of one of the pairs is provided with a socket adjacent each of the walls on the other pairs to form two pairs of opposed sockets. The door includes a pair of pivot pins which are removably inserted in one of the pairs of sockets. The pivoting direction of the door can be reversed by inserting the pivot pins in the other pair of sockets. The door is retained in a closed position by a magnet on the door and metal plates on the walls of one of the pairs.

4 Claims, 2 Drawing Sheets

PORTABLE THERMAL CONTAINER WITH REVERSIBLE DOOR

BACKGROUND

This invention relates to portable thermal containers such as thermoelectric heating and cooling devices, picnic coolers, ice chests, and the like. More particularly, the invention relates to such a thermal container with a reversible door.

Picnic coolers, thermoelectric heaters and coolers, and similar containers typically include a lid or door for closing the thermal compartment thereof. If the lid or door is pivotally mounted adjacent one of the walls of the container, the door can be opened in only one direction.

A pivoting door which opens in only one direction limits the versatility of the container. The container must always be positioned so that opening of the door is not hindered by adjacent objects.

The versatility of a container with a pivoting door is particularly limited if the container is positioned so that the door extends in a vertical plane and pivots about a vertical axis. Opening of a vertically pivoting door is more easily hindered. Further, right-handed and left-handed persons often prefer to open such a door in different directions.

Many thermal containers can be supported on either end so that the direction in which the door pivots can be reversed simply by inverting the position of the container. However, some containers are optimally used in only one position, for example, because of internal shelves, internal storage compartments, etc.

Thermoelectric containers present a particular problem. Such containers are well known and include a D.C. thermoelectric unit or heat pump which either heats or cools the internal compartment depending upon the polarity of the connection to the D.C. power source. The thermoelectric unit typically includes a fan for drawing air through an air intake opening, distributing conditioned air within the compartment, and venting air to the outside through an exhaust opening.

The intake and exhaust openings are usually provided in one of the end walls of the container so that the container can be used in either a chest position or in an upright position. In the chest position the door pivots upwardly about a horizontal axis, and the wall with the vent openings forms one of the side walls of the container. In the upright position the door pivots about a vertical axis, and the wall with the vents forms the top wall of the container.

Most thermoelectric containers can be used in only one upright position because of the vent openings. The vent openings should be in the top wall and not the bottom wall. If the vent openings were in the bottom wall, ventilation could be blocked by the supporting surface and the operation of the thermoelectric device could be adversely affected. Such a thermoelectric cooler could not be inverted in order to change the direction in which the door opens.

SUMMARY OF THE INVENTION

The invention provides a reversible door for a portable thermal container, particularly a thermoelectric heating and cooling container. The container includes two parallel walls which form the top and bottom of the container and two parallel walls which form the sides of the container when the container is in an upright position and the door pivots about a vertical axis. Vertically aligned sockets are provided in the top and bottom walls at both the right and left ends of the walls. A pivot pin extends upwardly from the top edge of the door and a pivot pin extends downwardly from the bottom edge of the door. The pivot pins are removably inserted in the sockets on either the right or left ends of the top and bottom walls. The position of the door can be reversed by withdrawing the pivot pins from one set of sockets, inverting the door, and inserting the pins in the other set of sockets. A metal plate is mounted on each of the side walls, and the door is retained closed in either position by a magnet on the door which magnetically attracts one of the metal plates.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
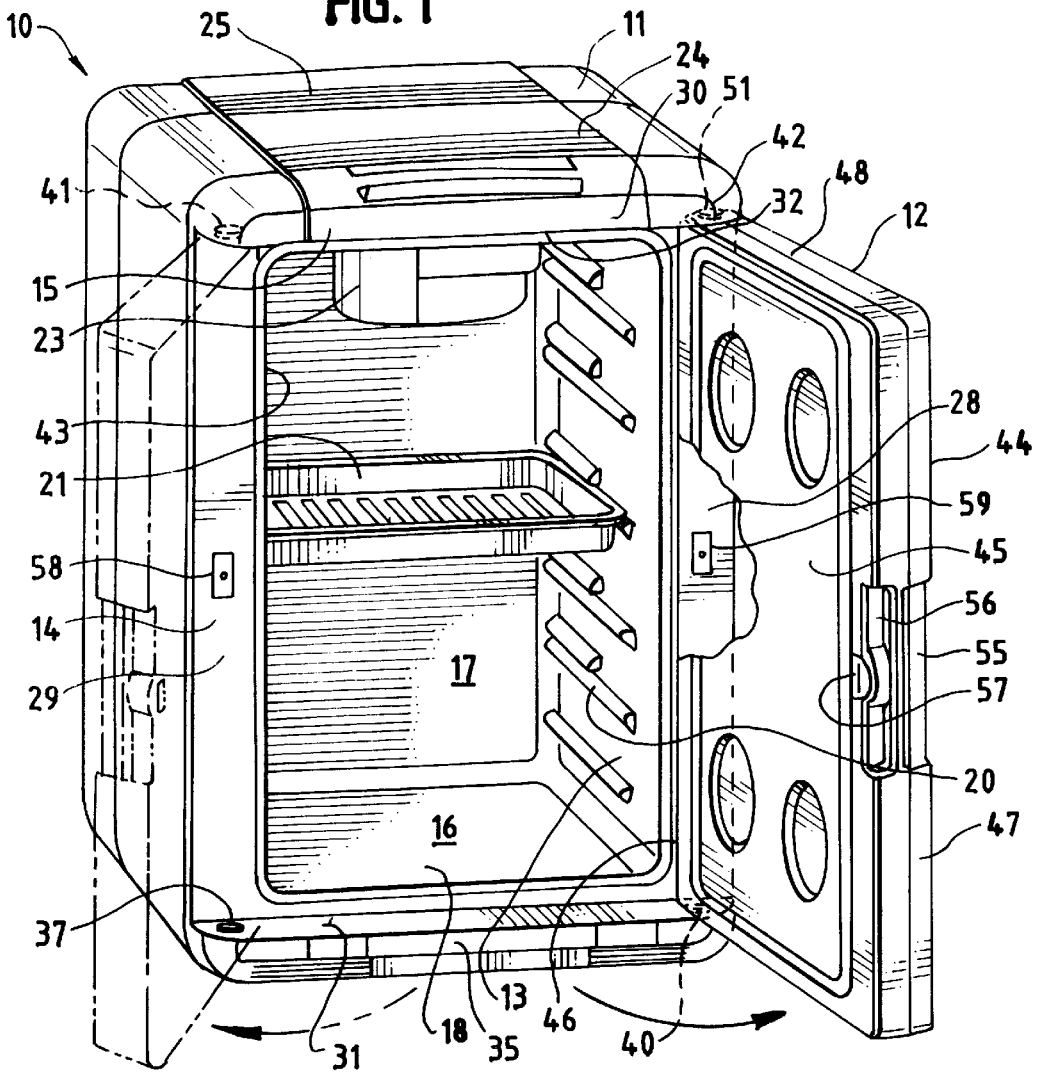
FIG. 1 is a perspective view of a thermoelectric heating and cooling container which is equipped with a reversible door in accordance with the invention.

The invention will be explained in conjunction with a portable thermoelectric container 10. It will be understood, however, that the invention can be used with other types of thermal containers, such as picnic coolers, ice chests, and the like. The invention finds particular utility in portable thermoelectric devices because the vents which are typically required in thermoelectric containers limit the orientation in which the container can be positioned.

The container 10 includes a housing or casing 11 and a door 12. The housing is illustrated in an upright position in FIG. 1 and includes a pair of parallel side walls 13 and 14, parallel top and bottom walls 15 and 16, and a back wall 17. The walls include inside surfaces which form an internal enclosure or compartment 18 and outside surfaces which define the exterior of the housing. In the particular embodiment illustrated, parallel ribs or ledges 20 are formed on the inside surfaces of the side walls for slidably supporting trays 21.

A conventional thermoelectric unit 23 is mounted inside of the compartment on the top wall 15. Such thermoelectric units are well known and need not be described herein. They typically include a D.C. powered thermoelectric device, fins which are heated or cooled depending upon the polarity of the connection of the D.C. power source, and a fan which forces air over the fins and into the compartment. The fan draws intake air from outside of the container through a vented inlet opening 24 in the top wall and forces exhaust air out of the compartment through a vented exhaust opening 25 in the top wall.

The side walls 13 and 14 include flat front edge surfaces 28 and 29. The top and bottom walls 15 and 16 extend forwardly beyond the front edges 28 and 29 of the side walls to form top and bottom ledges 30 and 31 which terminate in front edges 32 and 33. The top ledge 30 includes a downwardly facing flat surface, and the bottom ledge 31 includes an upwardly facing flat surface 35.

Figure 3:
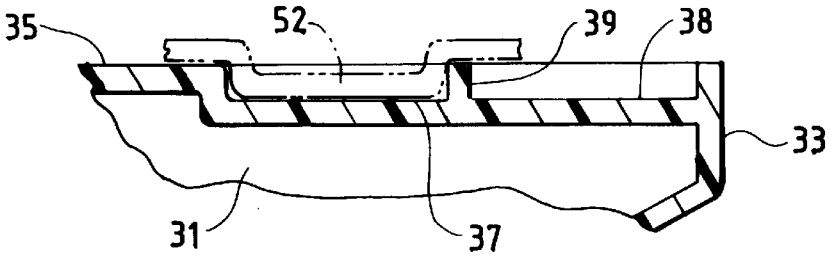
FIG. 3 is a fragmentary sectional view taken along the line 3—3 of FIG. 2.

Referring to FIG. 3, a socket 37 is formed in the top surface of the bottom ledge 31 in substantial alignment with the left side wall 14. A recess 38 is also formed in the ledge adjacent the socket to form a relatively thin arcuate wall 39 around a portion of the socket. The walls of the housing are advantageously molded from plastic, and the wall 39 is flexible and resilient.

A similar socket 40 and corresponding recess is provided in the bottom ledge 31 in substantial alignment with the right side wall 13. Similarly, sockets 41 and 42 and corresponding recesses are formed in the bottom surface of the top ledge 30. The top socket 41 is vertically aligned with the bottom socket 37, and the top socket 42 is vertically aligned with the bottom socket 40.

Figure 2:
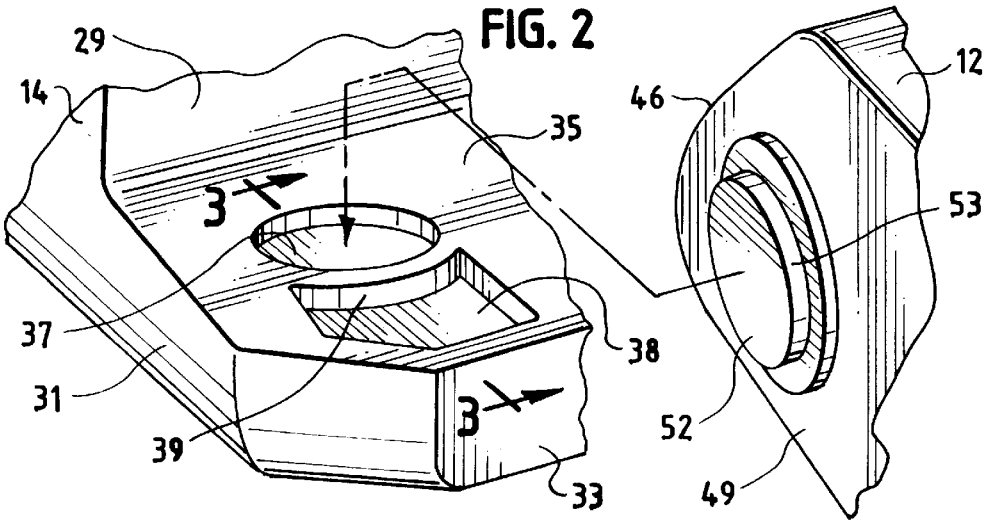
FIG. 2 is a fragmentary perspective exploded view of one of the pivot connections between the door and the housing.

The door 12 is generally rectangular and is sized to cover a front access opening 43 in the housing. The door includes inside and outside surfaces 44 and 45, parallel right and left side surfaces 46 and 47, and parallel top and bottom surfaces 48 and 49. An upper pivot pin 51 extends upwardly from the top surface 48 adjacent the right side 46, and a bottom pin 52 (FIG. 2) extends downwardly from the bottom surface 49 adjacent the right side 46. Each of the pivot pins has a generally cylindrical side surface 53 (FIG. 2), and the axes of the pins are aligned and extend parallel to the right side surface 46.

The pivot pins are removably inserted into the top and bottom right side sockets 40 and 42 as shown in solid outline in FIG. 1. The door can be mounted on the housing by inserting one of the pins into the associated socket, and then forcing the other pin over the flexible annular wall 39 of the other socket until the pin is positioned in the socket. The door can be removed from the housing by following the reverse procedure.

Pivot pins and sockets with flexible annular walls corresponding to the pins 51 and 52, sockets 40 and 42, and annular walls 39 have been used on prior art picnic coolers in order to provide the cooler with a removable door. However, prior art coolers have not previously included pairs of sockets on both sides of the cooler in order to provide a reversible door.

The left side 47 of the door includes a handle 55 which is formed by a recess 56 in the inside surface 44. A magnet 57 is mounted on the inside surface of the handle. A metal plate 58 is mounted on the front surface 29 of the left side wall of the cooler for releasably retaining the door in a closed position by the magnetic force between the magnet and the metal plate.

FIG. 1 illustrates the thermoelectric container in an upright position. The container is supported by the bottom wall 16, and the intake and exhaust vents 24 and 25 are in the top wall to provide unobstructed air flow into and out of the container. The door is pivotally mounted on the right side and opens from left to right.

Figure 4:
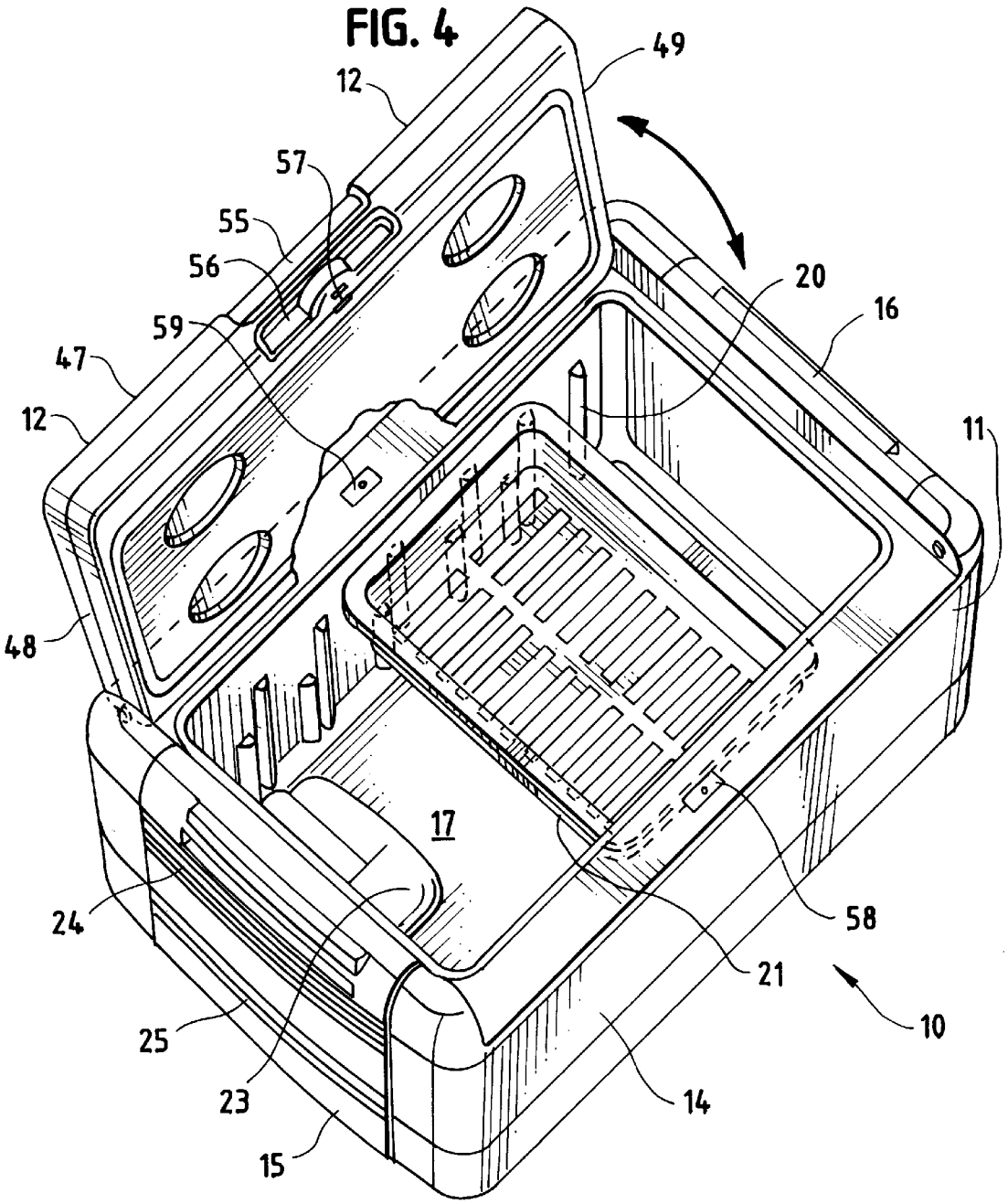
FIG. 4 is a perspective view, partially broken away, of the container in a chest position.

FIG. 4 illustrates the thermoelectric container in a chest position in which the container is supported on the wall 17. The vent openings 24 and 25 are on the left side of the container as positioned in FIG. 4. The door opens upwardly. If desired, the trays 21 can be supported horizontally by the ends of the ribs 20.

Referring again to FIG. 1, if it is desired to reverse the door, the door is removed from the housing by first forcing one of the pivot pins out of its socket by flexing the arcuate wall 39 and then withdrawing the other pivot pin from its socket. The door is then turned upside down so that the pivot pins are located on the left side of the door. The pivot pins are inserted into the left pair of sockets 37 and 41 as illustrated in phantom. A metal plate 59 is mounted on the front surface 28 of the right side wall 13 for cooperating with the magnet 57 for releasably retaining the door in a closed position.

Because only the door is inverted and not the housing, the housing is still supported by the bottom wall 16, and the air vents 24 and 25 are still located on the top of the cooler. The door can therefore be reversed without changing the position of the air vents.

While in the foregoing specification a detailed description of specific embodiments of the invention was set forth for the purpose of illustration, it will be understood that many of the details herein given can be varied considerably by those skilled in the art without departing from the spirit and scope of the invention.

I claim:

1. A portable thermal container comprising a housing having a pair of generally parallel side walls, generally parallel top and bottom walls, and a back wall, each of the walls having inner and outer surfaces, each of the side walls having front edge surfaces, each of the top and bottom walls having front edge surfaces, the inner surfaces and front edge surfaces of the top and bottom walls extending forwardly of the front edge surfaces of the side walls to form top and bottom ledge portions, and a generally rectangular door having a pair of generally parallel side surfaces and generally parallel top and bottom surfaces, the side surfaces of the door extending adjacent the front edge surfaces of the side walls and the top and bottom surfaces of the door extending along the inside surfaces of the top and bottom ledge portions, a top pivot pin on the top surface of the door adjacent one of the side surfaces of the door, a bottom pivot pin on the bottom surface of the door adjacent said one side surface of the door, the top ledge having a socket in the inside surface thereof adjacent each of the side walls, the bottom ledge having a socket in the inside surface thereof adjacent each of the side walls, the pivot pins being pivotally and removably inserted into the sockets adjacent one of the side walls.

2. The container of claim 1 including means on each of the side walls and on the door for retaining the door in a closed position in which it extends between the side walls.

3. The container of claim 2 in which the retaining means includes a metal plate on the front edge of each of the side walls and a magnet on the door.

4. The container of claim 1 including a thermoelectric unit mounted in the housing, the top wall being provided with a vent for the thermoelectric unit.

* * * * *